United States Patent [19]

Nomura et al.

[11] Patent Number: 4,766,828

[45] Date of Patent: Aug. 30, 1988

[54] PATTERN SENSOR FOR SEWING MACHINE FEED ADUSTING SYSTEM

[75] Inventors: Etsuzo Nomura, Kasugai; Shigeru Suzuki, Nagoya, both of Japan

[73] Assignee: Brother Kogyo Kabushiki Kaisha, Aichi, Japan

[21] Appl. No.: 84,028

[22] Filed: Aug. 11, 1987

[30] Foreign Application Priority Data

Aug. 14, 1986 [JP] Japan ..... 61-190945

[51] Int. Cl.[4] ..... D05B 27/06; D05B 27/08

[52] U.S. Cl. ..... 112/314; 112/153; 112/320

[58] Field of Search ..... 112/314, 313, 306, 320, 112/312, 315, 121.11, 121.26, 153, 272; 250/559

[56] References Cited

U.S. PATENT DOCUMENTS

| | | | |
|---|---|---|---|
| 3,954,071 | 5/1976 | Mall et al. | 112/311 |
| 4,342,273 | 8/1982 | Petzold | 112/272 |
| 4,612,867 | 9/1986 | Rösch et al. | 112/314 |
| 4,658,741 | 4/1987 | Jehle et al. | 112/314 X |

FOREIGN PATENT DOCUMENTS

| | | | |
|---|---|---|---|
| 1167636 | 4/1964 | Fed. Rep. of Germany | 112/121.11 |
| 58-50487 | 3/1983 | Japan . | |
| 2097153 | 10/1982 | United Kingdom | 112/121.11 |

*Primary Examiner*—Peter Nerbun

*Attorney, Agent, or Firm*—Parkhurst & Oliff

[57] ABSTRACT

A pattern sensor installed in a sewing machine for sensing patterns on two opposing sheets of cloth so that the patterns on the separate cloths are correctly aligned while sewing. The sensor is composed of a sensor head disposed between the two sheets of cloth, a light source, a light receiver, two light conduits including bundles of thin optical fibers, and a reflector which is composed of two prisms provided in the sensor head. The light emitted from the light source is transmitted via separate conduits and respectively enters the prisms. One beam is reflected upward toward the upper cloth, and the other is reflected downward toward the lower cloth for sensing the patterns. The light reflected on each cloth returns to the light receiver via the reverse route to be processed as a pattern signal.

11 Claims, 5 Drawing Sheets

PATTERN SENSOR FOR SEWING MACHINE FEED ADUSTING SYSTEM

BACKGROUND OF THE INVENTION

1. Field of the Invention

This invention relates to a pattern sensor for a sewing machine for maintaining correct alignment of a pattern on two layered sheets of cloth during sewing.

2. Prior Art

One type pattern sensor of a sewing machine is disclosed in U.S. Pat. No. 4,612,867. In this art, two sensors are provided facing each other with the cloths therebetween. Namely, one is provided over an upper cloth and the other is provided under a lower cloth. These two sensors respectively sense a pattern on each cloth at a predetermined position upstream of a stitching position.

When two sheets of cloth having patterns on their front surfaces are stitched up together so as to align their patterns by a sewing machine utilizing the above-mentioned prior art sensors, an operator is required to first visually align the patterns of the two sheets of cloth before the operator sets the cloths on the machine. Moreover, the operator must hold the cloths at a position upstream of the stitching position so as to align the edges of the two sheets of cloth during sewing. If the edges become unaligned, it becomes impossible to accurately sense the patterns, since each of the sensors respectively senses a pattern at a different position. Such incorrect sensing of patterns on the separate sheets of cloth makes it hard to correctly align the patterns. As a result, two sheets of cloth are sewn together with the patterns out of alignment. In order to avoid the disalignment of the edges, the sewing speed must be decreased so that the operator can accurately align the edges of the two sheets of cloth.

Two sheets of cloth are usually sewn with each of the fronts inside so that the fronts appear on a same side and the seams do not show. The sensors of the prior art, which are located over and under the cloths, therefore, sense the patterns from the back. In the case of sensing the patterns printed on the front, it is hard to accurately sense the patterns from the back, since the patterns sometimes do not appear clearly on the back. For solving the above-mentioned problem, it is possible to vertically dispose the sensors between the two sheets of cloth at a certain distance upstream of the stitching position. In this case, however, since the upper and the lower cloths are so separated significantly, it is difficult to handle the two sheets of cloth.

To cope with this, it is possible to dispose the two sensors horizontally so as to reduce the distance separating the two sheets of cloth. In this case, however, another problem will result. Since the sensors respectively sense patterns at separate positions, the pattern signals sent from the sensors must be corrected based on the positional difference of the sensors.

SUMMARY OF THE INVENTION

Accordingly, an object of the present invention is to provide a pattern sensor which is possible to sense the printed patterns of two sheets of material so as to correctly align the patterns during sewing.

Another object of the present invention is to provide a pattern sensor which enables high-speed sewing while maintaining correct alignment of patterns on two sheets of cloth.

A further object of the present invention is to provide a pattern sensor which can accurately sense the patterns of printed cloth at the same position relative to the stitching position, namely, a pattern sensor in which pattern signals can be easily processed without troublesome correction of pattern signals.

To achieve these and other objects, the pattern sensor of the present invention for sensing patterns on opposing surfaces of two sheets of material so as to align the patterns in a predetermined relation, has a constitution set forth below. Namely, the pattern sensor includes:

- a light source for generating a light;
- a light receiver for receiving the light; and
- a sensor head disposed between said two sheets of material for sensing the patterns of the two sheets of material, said sensor head reflecting the light from said light source to each of the opposing surfaces of the two sheets of material and reflecting the light reflected from the same to said light receiver.

BRIEF DESCRIPTION OF THE DRAWINGS

For a more complete understanding of the present invention and the advantages thereof, reference is now made to the following descriptions in conjunction with the accompanying drawings in which.

DETAILED DESCRIPTION OF PREFERRED EMBODIMENT

Set forth below is the explanation of a first embodiment of the present invention based on FIGS. 1 through 6.

Figure 4:
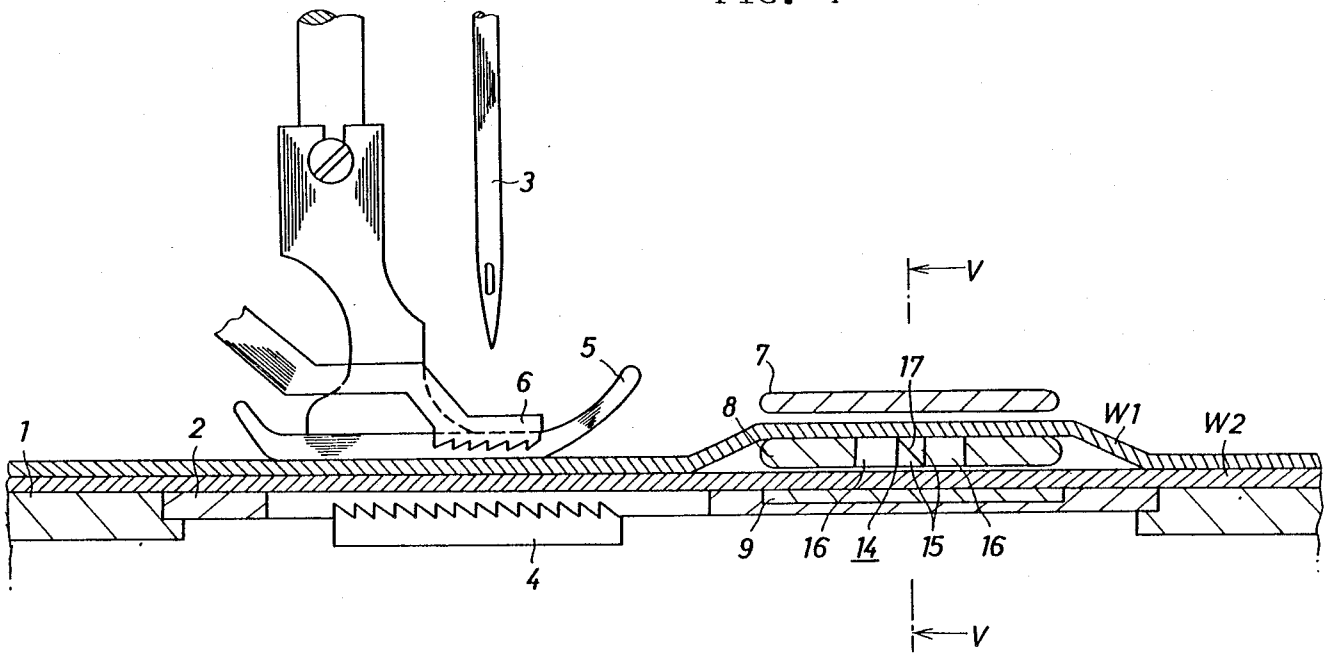
FIG. 4 is a vertical sectional view of the stitching position and the sensing position of a sewing machine shown in FIG. 1.
Figure 5:
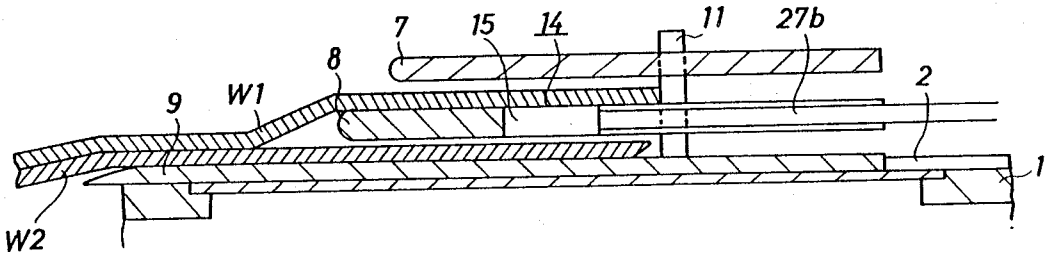
FIG. 5 is a sectional view taken along line V—V of FIG. 4.

As shown in FIG. 4, a needle plate 2 is attached on a machine bed 1. By the cooperation of a needle 3 which moves up and down through the needle plate 2 and a looper (not shown) installed in the machine bed 1, two sheets of cloth W1 and W2 are sewn together. In the proximity of the stitching position, a lower feed dog 4 is installed below the needle plate 2 to be movable in both longitudinal and transverse directions. The lower feed dog 4 and a presser foot 5 cooperate to feed both the upper and lower cloths W1 and W2. An upper feed dog 6 is arranged on both sides of the presser foot 5. The upper feed dog 6 is also movable in longitudinal and transverse directions which gives a supplementary movement to the feed of the upper cloth W1. In this embodiment, the feed by the upper feed dog 6 can be controlled by a known feed controller.

Figure 1:
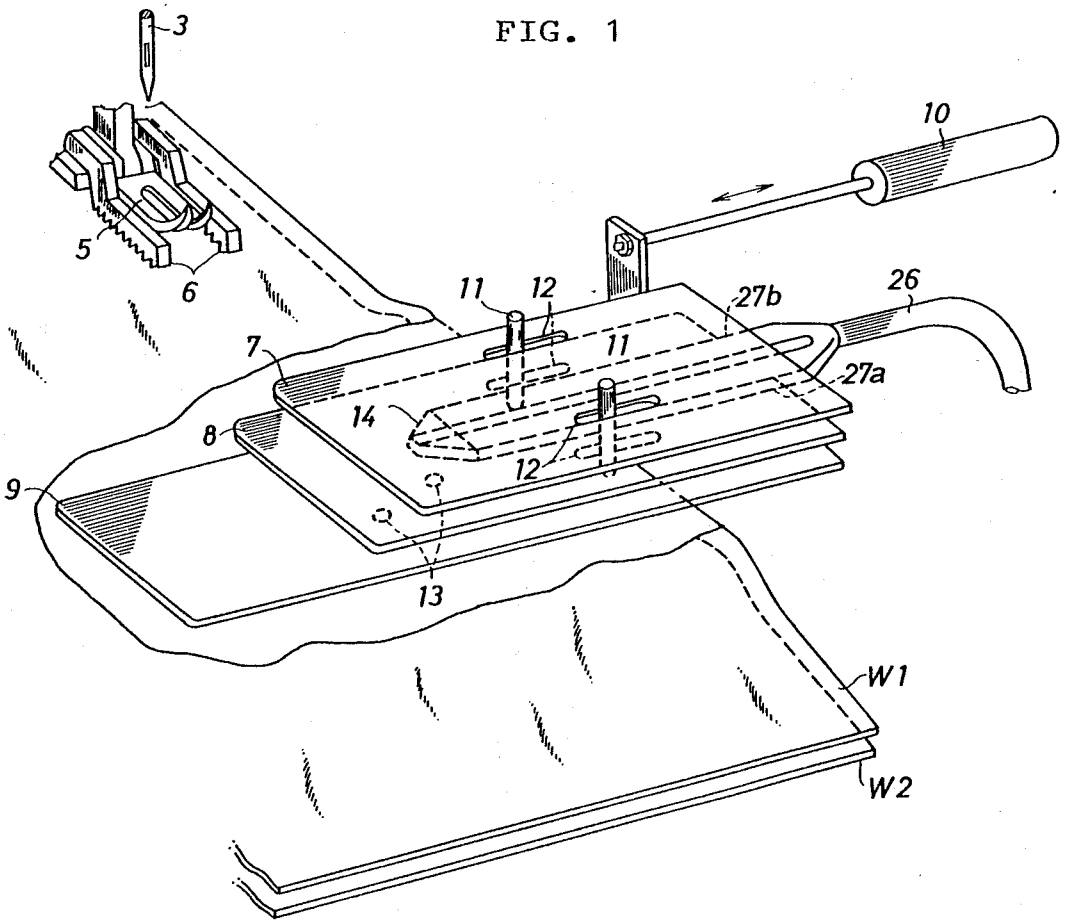
FIG. 1 is a perspective view of a sewing machine utilizing a pattern sensor of a first embodiment of the present invention.

As illustrated in FIG. 1, at a certain distance from the stitching position in the upstream side, three guide plates 7, 8 and 9 are disposed at certain intervals from one another. These guide plates are shifted to an operational position (left side in FIG. 1) and to an non-operational position (right side) by actuating an air cylinder 10. When the guide plates 7–9 are non-operational, the distance between each of the guide plates is increased by an adjuster (not shown), so that the cloths W1 and W2 can be easily inserted into the spaces between the guide plates 7 and 8, and between 8 and 9, respectively. After that, when the guide plates 7–9 are set in the operational position, the distance between each of the guide plates is decreased. The lower guide plate 9 makes a flush surface with the needle plate 2 in this operational position. Under such conditions, the cloths W1 and W2 are fed.

As shown in FIG. 1, a pair of regulator pins 11 projects upward from the lower guide plate 9 through slots 12 formed in the middle and upper guide plates 8 and 7. At one corner of the under surfaces of the guide plates 7 and 8, semispherical projections 13 are formed. Since the projections 13 function to slightly hold the cloths W1 and W2 while the cloths W1 and W2 are fed, the cloths receive a counterclockwise moment during sewing. The edges of the cloths W1 and W2 are restricted by regulator pins 11, therefore, the edges of the cloths W1 and W2 can be accurately aligned.

Figure 6:
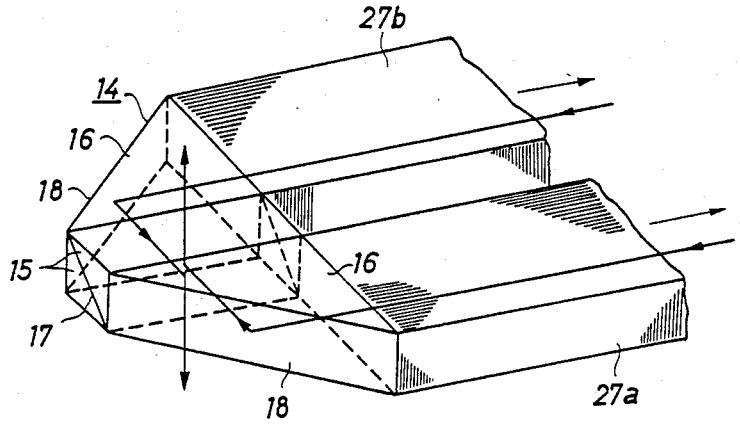
FIG. 6 is a perspective view illustrating a sensor head of the pattern sensor of the first embodiment.

Within the middle guide plate 8 which is disposed between the cloths W1 and W2, a pattern sensor head 14 is installed. As shown in FIG. 6, the sensor head 14 includes a pair of first prisms 15 and a pair of second prisms 16. Each of the first prisms 15 is a triangle pole whose cross section is an isosceles right triangle, whose hypotenuse is joined with that of the hypotenuse of the other prism. The second prisms 16 consist of two triangle poles each of whose horizontal section is an isosceles triangle. The second prisms 16 are disposed on both sides of the first prisms in the sewing direction. On each of the connected surfaces of the first prisms 15, a reflector 17 is formed by deposition of an aluminum vapor. Also on the hypotenuse surfaces of the second prisms 16, reflectors 18 are formed by deposition of an aluminum vapor.

Figure 3:
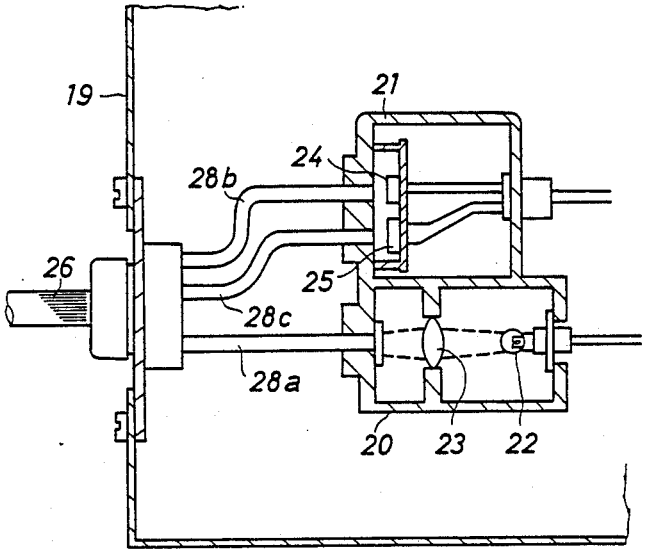
FIG. 3 is a partial sectional view of a control box.

FIG. 3 illustrates a control box 19 attached to a machine frame (not shown). As shown in the figure, an emitter 20 and an receiver 21 of light sensed by the sensor head 14 are provided in the control box. The emitter 20 is equipped with a light source 22 and a lens collimator 23. The receiver 21 includes a first photo sensitive diode 24 for the upper cloth W1 and a second photo sensitive diode 25 for the lower cloth W2. As illustrated in FIG. 1, both the emitter 20 and the receiver 21 are connected with the sensor head 14 by means of a light conduit 26. The light conduit 26 contains a bundle of thin optical fibers. One end of the optical fiber bundle is separated into a branch **27*a* for emitting/receiving light to/from the upper cloth W1, and into a branch 27*b* for emitting/receiving light to/-from the lower cloth W2 via the sensor head 14. The ends of the two branches abut on the second prisms 16 as in FIG. 6. The other end of the light conduit 26 is also separated, as shown in FIG. 3, into three branches, i.e., a branch 28*a* directed toward the collimator lens 23 of the emitter 20, a branch 28*b* directed toward the first photo sensitive diode 24, and a branch 28*c*** *l directed toward the second photo sensitive diode 25.*

Figure 2:
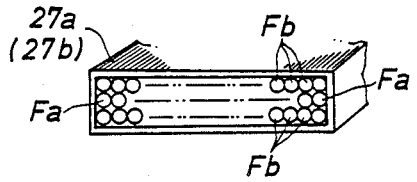
FIG. 2 is a sectional view of a light conduit composed of an optical fiber bundle.

The fiber bundles within the light conduit 26 include two bundles, i.e., Fa for emitting light to the cloth and Fb for receiving light reflected from the cloth. The ratio of the number of fibers contained in Fa and Fb are previously determined as shown in FIG. 2.

Each of the branches **27*a* and 27*b* include half of the two fiber bundles Fa and Fb. The ends of the bundles Fa and Fb in the branches 27*a* and 27*b* abut on the second prisms 16 of the sensor head 14**.

The end of the emitter side of the fiber bundle Fa forms the branch **28*a* of the light conduit 26 and faces the collimator lens 23. The end of the receiver side of the fiber bundle Fb is separated into the branches 28*b* and 28*c* from the light conduit 26, and each end faces with the photo sensitive diodes 24 and 25**, respectively.

When the machine is started, the two sheets of cloth W1 and W2 are fed by the upper and the lower feed dogs 6 and 4 through the guide plates 7, 8 and 9. At this time, the cloths W1 and W2 are sewn together along their edges by the cooperation of the needle 3 and the looper. During sewing, the light emitted from the emitter 20 passes through the light conduit 26, and is separated into the branches **27*a* and 27*b* as illustrated in FIG. 6. The separated light beams enter into each of second prisms 16, and are then reflected by the reflector planes 18 in a direction parallel to the sewing direction. The light from the branch 27*a* is then reflected upward toward the under surface of the upper cloth W1 by the reflector plane 17 of the first prisms 15. On the other hand, the light from the branch 27*b* is then reflected downward to the upper surface of the lower cloth W2 by the reflector plane 17 of the first prisms 15. The light reflected at the cloths W1 and W2 is transmitted back to the receiver 21** via the reverse route.

The sensor senses the patterns on the front of the cloths W1 and W2, and outputs pattern signals. The pattern signals from the cloths W1 and W2 are compared by a controller (not shown). If the pattern signals do not match with each other, the amount of feed of the upper feed dog 6 is adjusted in relation to that of the lower feed dog 4 by the aforementioned feed controller, so that the patterns of the cloths W1 and W2 are correctly aligned. Since the sensor head 14 disposed between the cloths W1 and W2 features a thin body, the distance between the upper cloth W1 and the lower cloth W2 can be minimized. As a result, the two sheets of cloth can be easily handled. Accordingly, by utilizing the sensor of the present invention, it is possible to accurately sense the patterns printed on the front surfaces at the same positions relative to the stitching position, at a high speed without troublesome correction of pattern signals.

Figure 7:
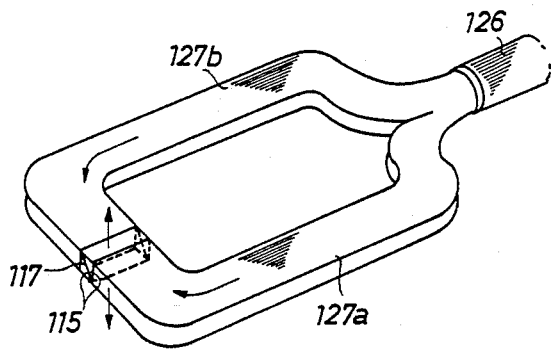
FIG. 7 is a perspective view showing a sensor head of the pattern sensor of the second embodiment.

Set forth below is an explanation of the second embodiment based on FIG. 7.

One of the significant features of the second embodiment is that the ends of branches **127*a* and 127*b* extending from a conduit 126 are curved to face with each other. Another is that only a pair of prisms 115 is employed the prisms 115 being the same as the first prisms 15 of the first embodiment is employed. The curved ends of the branches 127*a* and 127*b* are connected with both sides of the prisms 115. Namely, the light passed through the branches 127*a* and 127*b* directly enters the prisms 115, and is reflected at reflector planes 117. The light from the branch 127*a* is reflected upward to the upper cloth W1 and the light from the branch 127*b* is reflected downward to the lower cloth W2. Each of the lights reflected on the cloths W1 and W2** is transmitted via the reverse route in the same manner as mentioned in the first embodiment.

While the invention has been practically shown and described with reference to preferred embodiments, it will be understood by those skilled in the art that various other modifications may be made without departing from the spirit and scope of the invention. For example, it is possible to form the reflector planes 17 and 18 by a double-sided plane mirror or two single-sided mirrors without utilizing the prisms 15 and 16.

What is claimed is:

1. A pattern sensor for sensing patterns on opposing surfaces of two sheets of material utilized in a sewing machine for sewing the two sheets of material in such a manner that the patterns are aligned in a predetermined relation, comprising:

a light source for generating a light;

a light receiver for receiving the light; and a sensor head for sensing the patterns of the two sheets of material, said sensor head reflecting the light from said light source in one direction toward one opposing surface and in an opposite direction toward the other opposing surface of the two sheets of material, and reflecting the light reflected from the opposing surfaces to said light receiver.

2. A pattern sensor according to claim 1, wherein said sensor head is located in a separating plate between said two sheets of material at an upstream side of a needle of the sewing machine.

3. A pattern sensor according to claim 2, wherein said separating plate is provided in a guide device having said separating plate, an upper plate placed above said separating plate with an upper sheet of the two sheets of material therebetween and a lower plate placed below said separating plate with a lower sheet of the two sheets of material therebetween, for guiding both of the two sheets of material to a sewing point of said needle.

4. A pattern sensor for sensing patterns on opposing surfaces of two sheets of material utilized in a sewing machine for sewing the two sheets of material in such a manner that the patterns are aligned in a predetermined relation, comprising:

a light source for generating a light;

a light receiver for receiving light reflected from the surfaces of the two sheets of material;

a sensor head for sensing the patterns of the two sheets of material, said sensor head reflecting the light from said light source in one direction toward one opposing surface and in an opposite direction toward the other opposing surface;

two light conduits each for conducting the light from the light source to the sensor head and the light from the sensor head to the light receiver; and a reflector provided in the sensor head and connected to the two light conduits for reflecting the light from each of the light conduits to each of the opposing surfaces of the two sheets of material and for reflecting the light reflected from the opposing surfaces to each of the two light conduits.

5. A pattern sensor according to claim 4, wherein the reflector comprises two triangular prisms with their hypotenuses joined together, said hypotenuses reflecting the light, and each of said two light conduits being connected to one of said prisms at their abutting ends, and to said light source and said light receiver at the other end thereof.

6. A pattern sensor according to claim 5, wherein each of said two light conduits includes two bundles of thin optical fibers, one bundle for conducting light from the light source to said sensor head and the other bundle for conducting light from said sensor head to said light receiver.

7. A pattern sensor for sensing patterns on opposing surfaces of two sheets of material utilized in a sewing machine for sewing the two sheets of material in such a manner that the patterns are aligned in a predetermined relation, comprising:

a light source for generating a light;

a light receiver for receiving light reflected from the surfaces of the two sheets of material;

a sensor head for sensing the patterns of two sheets of material, said sensor head reflecting the light from said light source in one direction toward one opposing surface and in an opposite direction toward the other opposing surface, the sensor head being embedded in a supporting plate installed on a guide device for guiding the two sheets of material to a sewing point of a needle of the sewing machine;

two light conduits each for conducting the light from the light source to the sensor head and the light from the sensor head to the light receiver; and a reflector provided in the sensor head and connected to the two light conduits for reflecting the light from each of the light conduits to each of the opposing surfaces of the two sheets of material and for reflecting the light reflected from the opposing surfaces to each of the two light conduits.

8. A pattern sensor according to claim 7, wherein the reflector is a rectangular solid body which is composed of two triangular prisms with their hypotenuses joined together, said hypotenuses reflecting the light, and each of said light conduits being connected to one of said prisms at its abutting end, and to said light source and the light receiver at its other end.

9. A pattern sensor according to claim 8, wherein each of said two light conduits includes two bundles of thin optical fibers, one bundle for conducting light from the light source to said sensor head and the other bundle for conducting light from said sensor head to said light receiver.

10. A pattern sensor according to claim 7, wherein the sensor head further includes two rectangular prisms each attached to each of the two light conduits and both attached to either sides of the reflector for reflecting light from the light conduit to the reflector and vice versa.

11. A pattern sensor according to claim 7, wherein an end of each of the two light conduits are attached on either side of the reflector.

* * * * *